US005345428A

United States Patent [19]

Arnold et al.

[11] Patent Number: 5,345,428

[45] Date of Patent: Sep. 6, 1994

[54] FLEXTENSIONAL TRANSDUCERS

[75] Inventors: Douglas B. Arnold; George Bromfield, both of Dorset; John C. Gardner, Cheshire, all of England

[73] Assignee: The Secretary of State for Defence in Her Britannic Majesty's Government of the United Kingdom of Great Britain and Northern Ireland, London, England

[21] Appl. No.: 276,443

[22] PCT Filed: Mar. 17, 1987

[86] PCT No.: PCT/GB87/00189

§ 371 Date: Sep. 16, 1992

§ 102(e) Date: Sep. 16, 1992

[87] PCT Pub. No.: WO87/05773

PCT Pub. Date: Sep. 24, 1987

[30] Foreign Application Priority Data

| | | | |
|---|---|---|---|
| Mar. 19, 1986 | [GB] | United Kingdom | 8606743 |
| Mar. 19, 1986 | [GB] | United Kingdom | 8606744 |
| Mar. 19, 1986 | [GB] | United Kingdom | 8606746 |
| Mar. 19, 1986 | [GB] | United Kingdom | 8606747 |

[51] Int. Cl.[5] ..... H04R 1/44

[52] U.S. Cl. ..... 367/165; 367/163; 367/167; 29/25.35

[58] Field of Search ..... 367/157, 163, 167, 165, 367/172, 173, 174; 310/337; 29/25.35, 609.1

[56] References Cited

U.S. PATENT DOCUMENTS

| | | | |
|---|---|---|---|
| 4,420,826 | 12/1983 | Marshall, Jr. et al. | 367/167 |
| 4,435,794 | 3/1984 | Marshall, Jr. et al. | 367/155 |
| 4,941,202 | 7/1990 | Upton | 367/165 |

FOREIGN PATENT DOCUMENTS

0215657A2 of 1986 European Pat. Off. .

OTHER PUBLICATIONS

European Search Report.

*Primary Examiner*—Ian J. Lobo

*Attorney, Agent, or Firm*—Nixon & Vanderhye

[57] ABSTRACT

A high power, low frequency flextensional transducer (50) for underwater use comprises a number of spaced piezo-electric element stacks (53) between opposed inserts (51, 52). A Kevlar (registered trademark) compression band (54) is wound around the stacks and inserts and then partly elliptical plaster formers (56) are attached. A filament wound elliptical GRP flexural shell (57) is then wound around the assembly while controlling the tension so as to provide the required pre-stress on the piezo-electric stacks (53) when cured. After curing the plaster formers (56) are removed. End-plates (16) are attached to the elliptical shell (57) to complete the transducer; the shell (11) having a compression bonded layer (61) of neoprene applied, including a peripheral serrated lip seal (62) to seal against the end-plate (16) while permitting flexing of the shell. A device to provide wide bandwidth performance is also disclosed. To extend the range of operational depths the cavity within the transducer is filled with a gas whose vapour pressure can be temperature-controlled.

29 Claims, 8 Drawing Sheets

FLEXTENSIONAL TRANSDUCERS

BACKGROUND OF THE INVENTION

1. Field of the Invention

The invention relates to sonar transducers and in particular to elliptical shell flextensional transducers as described in U.S. Pat. No. 4,462,093 which are used to generate and radiate high power acoustic energy at low frequencies, typically in the range 200–3000 Hz.

2. Discussion of Prior Art

The construction of an elliptical shell flextensional transducer comprises fitting a piezo-electric stack (or stacks) along the major axis between opposing internal walls of an elliptical flexural shell in cylindrical form. Each stack consists of a number of piezo-electric plates between which are sandwiched metal electrodes, these in turn being connected in parallel. When an alternating voltage is applied to the electrodes a vibration is generated along the length of each stack. This vibration is transmitted to the shell and leads to an amplified out-of-phase vibration along the minor axis of the shell which provides the principal motive force for this sonar transducer.

Conversely, the transducer can be used in a passive mode in which received vibrations induce minor axis vibrations in the elliptical shell which in turn lead to electrical signals generated by the piezo-electric stacks.

The elliptical shells are commonly made of filament-wound glass reinforced plastics ("GRP"), the filament being wound around a suitable mandrel. The elliptical shell is then compressed along its minor axis by means of a press to permit assembly of the piezo-electric stacks along the major axis such that on removing the compressive force along the minor axis a residual tension remains in the shell to retain the stacks and apply a predetermined stress to the stacks. The stress applied to the piezo-electric stack must be set to a precise value, since when the transducer is deployed into water the increasing hydrostatic pressure with depth reduces the stress on the stack until a limit is reached beyond which the elliptical shell transducer cannot be driven without damage. To achieve the desired stress in the shell the piezo-electric stack output charge can be monitored at discrete conditions after placing shims of different discrete thickness at the end of the stack or continuously by using appropriately tapered wedges such as described in our copending patent application Ser. No. 8,606,745.

Flextensional transducers are normally sealed by means of end plates, however because they are capable of high power operation and thus the large amplitude flexing of the elliptical shell which occurs creates difficulties in water-tight sealing between the shell and end-plates since the sealing must be effective without limiting shell movement.

In order to operate there must be a pre-stress load applied by the elliptical shell to the transducer stacks. Operation over a wide range of pressure-depths requires that some form of pressure-balancing arrangements is provided.

Conventional pressure compensation or balancing systems have a number of operational disadvantages. The most common types of pressure balancing systems are air filled bladders and scuba type systems of which the latter use bottled compressed air coupled to a divers pressure balanced valve. The bladder method is severely limited as the volume of air in the cavity of the transducer is inversely proportional to the external hydrostatic pressure. The resulting reduction of the available swept volume for the active surface progressively lowers operating efficiency as the hydrostatic pressure is increased. The scuba system is a large and often relatively heavy appendage to a sonar transducer. In operation it can use large quantities of air if frequent changes in operating depth are required or if there are large unwanted depth excursions due to the effects of ocean swell on the deployment platform.

In a conventional design of flextensional transducer the dimensions of the shell are calculated to utilize the first and sometimes other flexural modes of vibration along the entire length of the oval cylinder. The shell has therefore a single resonance frequency and a finite bandwidth associated with each flexural mode.

SUMMARY OF THE INVENTION

The principal object of the present invention is to provide an elliptical shell flextensional transducer of simpler construction than currently available and susceptible of easier manufacture than hitherto possible.

A further object is to provide an improved sealing between the elliptical shell and the end-plates. In addition an object of the invention is to provide a transducer capable of operation over a wide range of pressure-depth. These, and other objects of the invention will be apparent from the following description.

The invention provides in one form an elliptical shell flextensional sonar transducer of the kind comprising at least one stack of piezo-electric elements interspersed by electrically conducting plates, the or each stack being in coplanar parallel spaced arrangement between a pair of spaced shell inserts, the assembly of stacks and inserts being disposed in the plane including the major axis of a hollow flexural shell of elliptical cross-section with the outer surfaces of the inserts in contact with the opposed inner surfaces of the shell and so shaped as to support the elliptical shape of the shell; wherein the improvement lies in:

providing a pair of resilient rectangular supports in spaced relationship, each support being in retaining contact with the two inserts and with one face making contact over its entire surface area with the adjacent inner surface of the shell.

The supports are preferably so formed that when in the unstressed condition they may be assembled with the shell inserts so as to form a support body generally elliptical in cross-section and in conformity with the inner cross-section of the shell.

By this arrangement the transducer may be assembled by winding a resin-coated fibre glass filament or similar composite material around the support body with the piezo-electric stacks assembled between the shell inserts.

Appropriate tensioning of the filaments will lead to the desired shell-induced stress on the piezo-electric stacks.

In one arrangement supports are sheets made of GRP and the shell inserts are provided with recesses for locating/retaining the support sheets in position.

In an alternative arrangement the support may comprise a stiff filament-wound layer encircling the piezo-electric stacks.

In this arrangement partially elliptical formers are assembled on the outer surfaces of the layer between the spacers so as to provide the overall elliptical former for winding on the flexural filament-wound shell.

Advantageously the stiff filament is Kevlar and the partially elliptical formers are made of plaster so as to be removeable after forming the shell.

In an alternative form the invention provides a method of making an elliptical shell flextensional transducer comprising the successive steps of:

a) assembling at least one piezo-electric stack between opposed shell inserts and spaced lengthwise of the inserts, and two spaced rectangular supports between the inserts such that the inserts and the supports form a uniform cylindrical support body with an elliptical outer cross-section; and b) winding a resin-soaked filament around the assembly to form the elliptical shell.

In one aspect the support sheets and the supports and shell are made from GRP. Furthermore the tension in the filament wound around the support body assembly is preferably controlled such that the completed elliptical shell exerts a predetermined stress force along the lengths of the piezo-electric stacks.

In another aspect the invention comprises the further step of winding a layer of a stiff filamentary material around the assembly of the or each piezo-electric stack and opposed shell inserts and attaching or forming partially elliptical supports on the outside surfaces of the layer between the inserts, the support material being selected such that it can be removed after winding the flexural elliptical shell. In this aspect the layer filament is Kevlar and the supports are made of plaster.

Advantageously there is provided a sealing member for sealing between the end plates and the flexural shell, the sealing member being a low shear modulus rubber vulcanised moulded to the outer surface of the flexural shell to form a continuous outer coating with integral lip seals on the end surfaces of the shell. Advantageously the rubber is neoprene rubber and is provided with a plurality of concentric elliptical serrations on the outer surface of the lip seal for contact with the respective end plate. The degree of compression is ideally between about 10% and 30% and this determines the depth of the serrations and the dimensions of the means for holding together the end plates and shell assembly. Preferably the overall thickness of the seal is determined by the peak magnitude of the shell vibration such that the sheer stress angle is limited to 30 deg. A plurality of tie bars are fixed between the two end plates and located inside or outside the shell to determine the compression of the lip seals.

In this arrangement of the invention a method of sealing end plates to a flextensional transducer includes the steps of:

a) locating the shell on a supporting mandrel;

b) compression moulding a low shear modulus rubber coating, for example neoprene, over the outer surface of the shell to form a lip seal integral therewith on each end of the shell;

c) assembling end-plates to the shell and tightening tie-bars between the end plates so as to give the required compression of the end plate seals between each end plate and its respective shell end.

Advantageously the vulcanised moulding is done in a hydraulic press. During assembly of the transducer a plurality of tie-bars interconnecting the end plates are adjusted in length to achieve the desired compression of the lip seals.

Alternatively the serrated lip seal can be compression moulded to each end closure plate and the complete transducer dip-coated in liquid neoprene.

For operation over a wide range of pressure-depth preferably there is provided a pressure compensation means comprising: a cavity defined in part by the shell of the flextensional transducer; a gas contained in the cavity; means to vary the temperature of the gas; a depth pressure sensor; and a control circuit connected to the pressure sensor and the temperature varying means to control the temperature of the gas such that the gas vapour pressure acting on the inner side of the shell is substantially the same as the depth pressure.

In one arrangement the temperature varying means is a heating element.

The gas may fill the cavity or alternatively it may fill a bladder within the cavity. In a further arrangement the cavity may contain a dual bladder. The gas may fill one section of the bladder and seawater the other section, the bladder being arranged in such a way that the gas is compressed by the external ambient hydrostatic pressure.

In the preferred arrangement the gas is dichlorodifluoromethane (freon). In addition to providing pressure compensation the gas-filled transducer can operate at a higher power duty cycle or higher ambient temperature than hitherto possible. Waste heat generated in the active piezo-electric elements of the transducer is transferred away more efficiently by the dichlorodifluoromethane and other similar suitable gases than by the conventionally used air or nitrogen. Suitable gases are those which have a convenient vapour pressure temperature characteristic. Thus these transducers can operate at greater depth than similar current transducers before thermal runaway.

In order to provide broad-band operation the two inserts located one at each end of the major axis between the shell wall and the corresponding end of the transducer stack and generally "D" shaped in cross section to maintain the elliptical shape of the shell may be formed such that the arcuate length of each insert surface in contact with the shell wall changes along the length of the shell cylinder.

In one form there may be one or more discrete length changes of the arcuate surface of each insert. By this means there are produced two or more regions along the length of the shell having differing free lengths of vibrating shell. Advantageously the shell is segmented along its length with weakened regions corresponding to the positions of changing cross section of the inserts. By this means a number of discrete fundamental flexural mode resonances can be excited by driving the piezo-electric stack assembly at these frequencies with the weakened portions assisting towards decoupling the different length portions of the shell.

In another form wherein the shell is uniform along its length the arcuate profile of each insert cross section is progressively changed along the length or part of the length of the shell.

BRIEF DESCRIPTION OF THE DRAWINGS

The invention will now be described by way of example only with reference to the accompanying Drawings of which.

DETAILED DISCUSSION OF PREFERRED EMBODIMENTS

Figure 1:
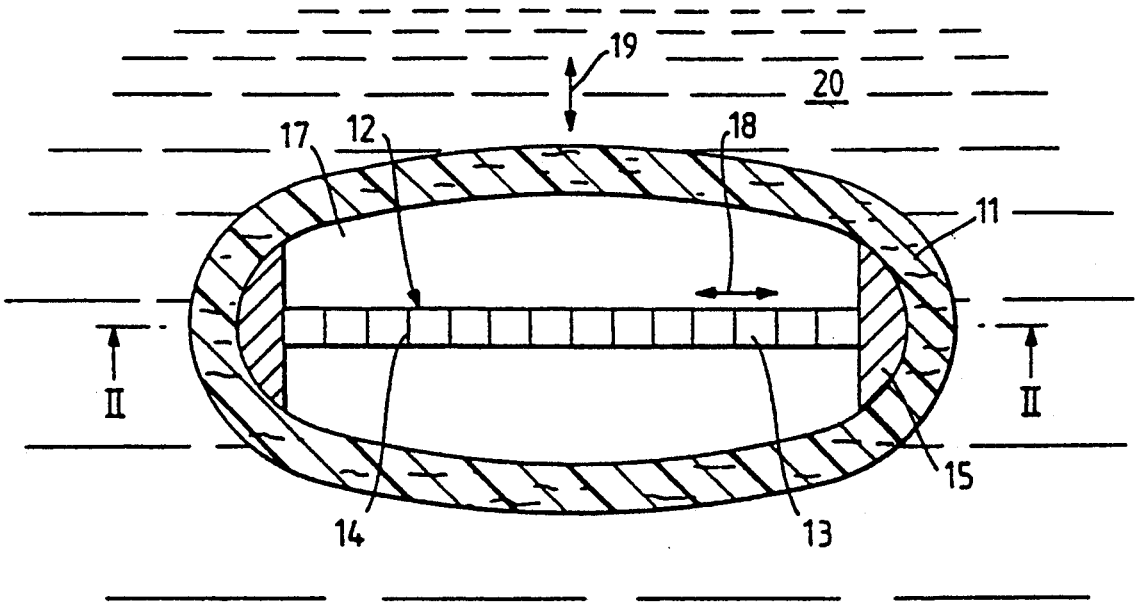
Fig. 1. (PRIOR ART)
FIGS. 1 and 2 show side elevation and plan cross-sections through a conventional elliptical shell flextensional transducer.
Figure 2:
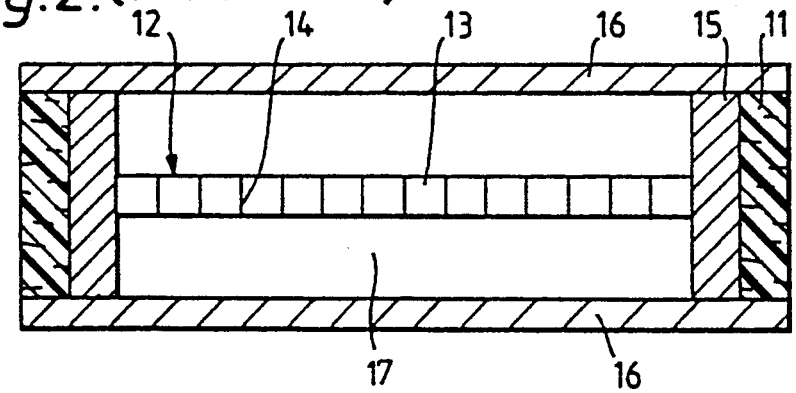
Fig. 2. (PRIOR ART)

The flextensional transducer shown in FIGS. 1 and 2 comprises a filament-wound GRP flexural shell 11 of an elliptical cylindrical form into which a piezo-electric stack 12 (or stacks) is fitted along the major axis of the ellipse. The stack 12 consists of a number of piezo-electric plates 13 between which are sandwiched metal electrodes 14 connected in parallel. "D" section end members 15 are provided to locate the ends of the stack 12. Steel end plates 16 are provided to close the ends of the elliptical shell 11 thereby defining a transducer cavity 17. The cavity 17 may be filled with dichlorodifluoromethane as will be described later. The elliptical shell flextensional transducer is used to generate and radiate high power acoustic energy at low frequencies, typically from 200 to 3000 Hz. The transducer is operated by applying an alternating voltage to the electrodes which causes vibrations to be generated in the directions 18 along the piezo-electric stack 12. These vibrations are transmitted to the elliptical shell 11 and lead to increased amplitude vibrations in the directions 19 on the minor axis of the shell. Conversely the transducer can be operated in a passive mode when pressure fluctuations in the surrounding medium 20 lead to vibrations in the directions 18 along the stack 12 which in turn lead to an alternating output signal from the transducer electrodes 14.

Figure 3:
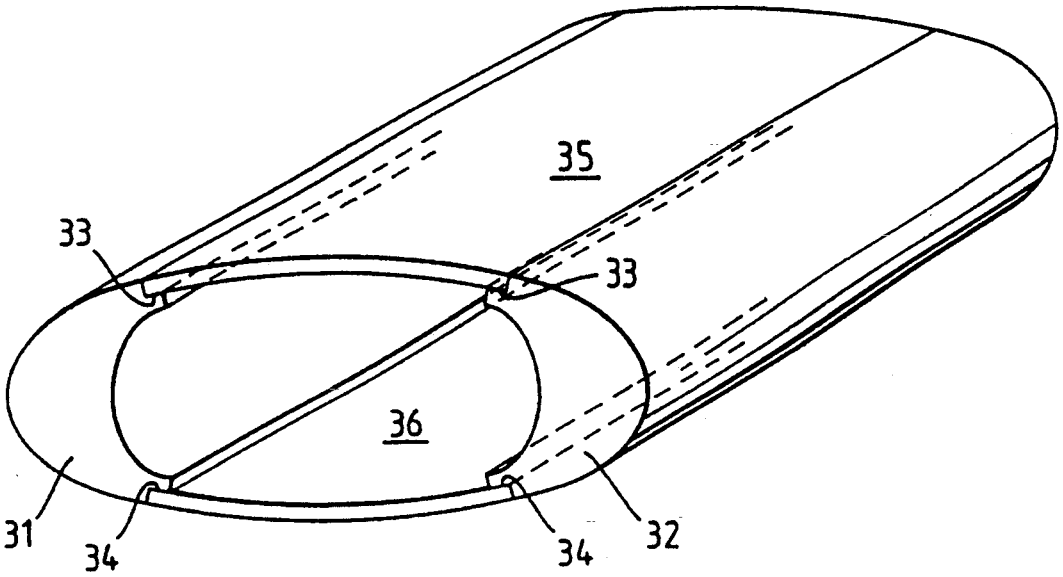
FIG. 3 shows a perspective view of the support body for an elliptical shell flextensional transducer.
Figure 4:
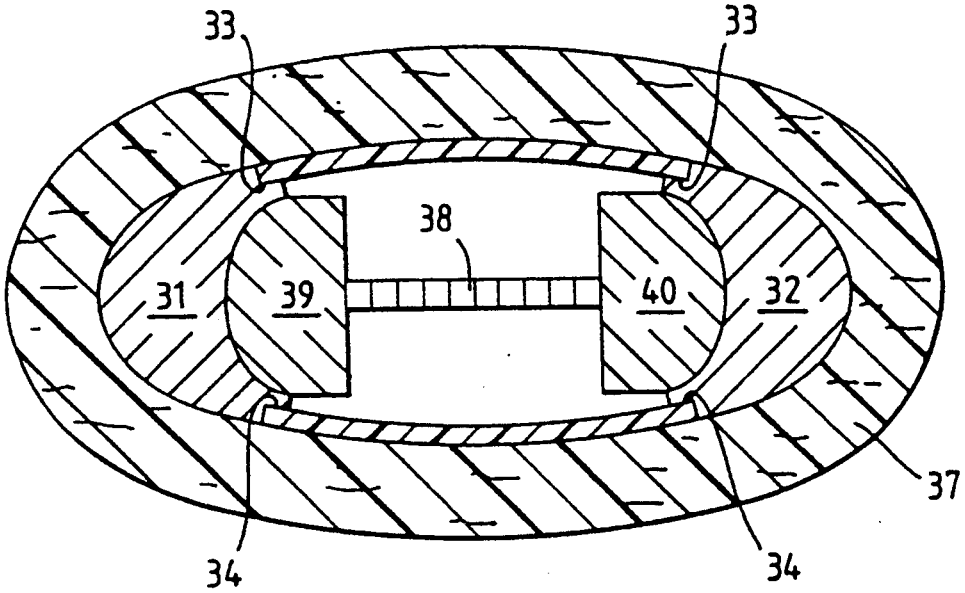
FIG. 4 shows the cross-section through the flextensional transducer according to the invention.

One arrangement according to the present invention shown in FIGS. 3 and 4 shows two shell inserts 31 and 32 provided along their upper and lower edges 33 and 34 with recesses extending along their lengths so as to provide seats for two curved rectangular resilient GRP support sheets 35 and 36. When assembled as shown in FIG. 3 the outer surface conforms substantially to the inner surface of the elliptical shell 37 of the flextensional transducer to be made.

Each transducer stack 38 is assembled in spaced relationship one to another between end plates 39 and 40, and the end plates are in contact with the inserts 31 and 32. The surfaces of the end plates 39,40 and the contacting surfaces of the inserts 31,32 are radiused to improve the alignment of the transducer stack assembly. Support plates 35 and 36 are placed in position within the recesses 33,34 in the shell inserts 31,32 as shown in FIG. 3. The GRP shell 37 is then filament-wound around the inserts and the support sheets. Means common in the art is provided to adjust the tension of the filament such that the overall tension exerted on the piezo-electric stacks 38 by by the completed elliptical shell 37 reaches the design value. This may be monitored by taking repeated readings of the outputs of the piezo-electric stacks 38.

Figure 5:
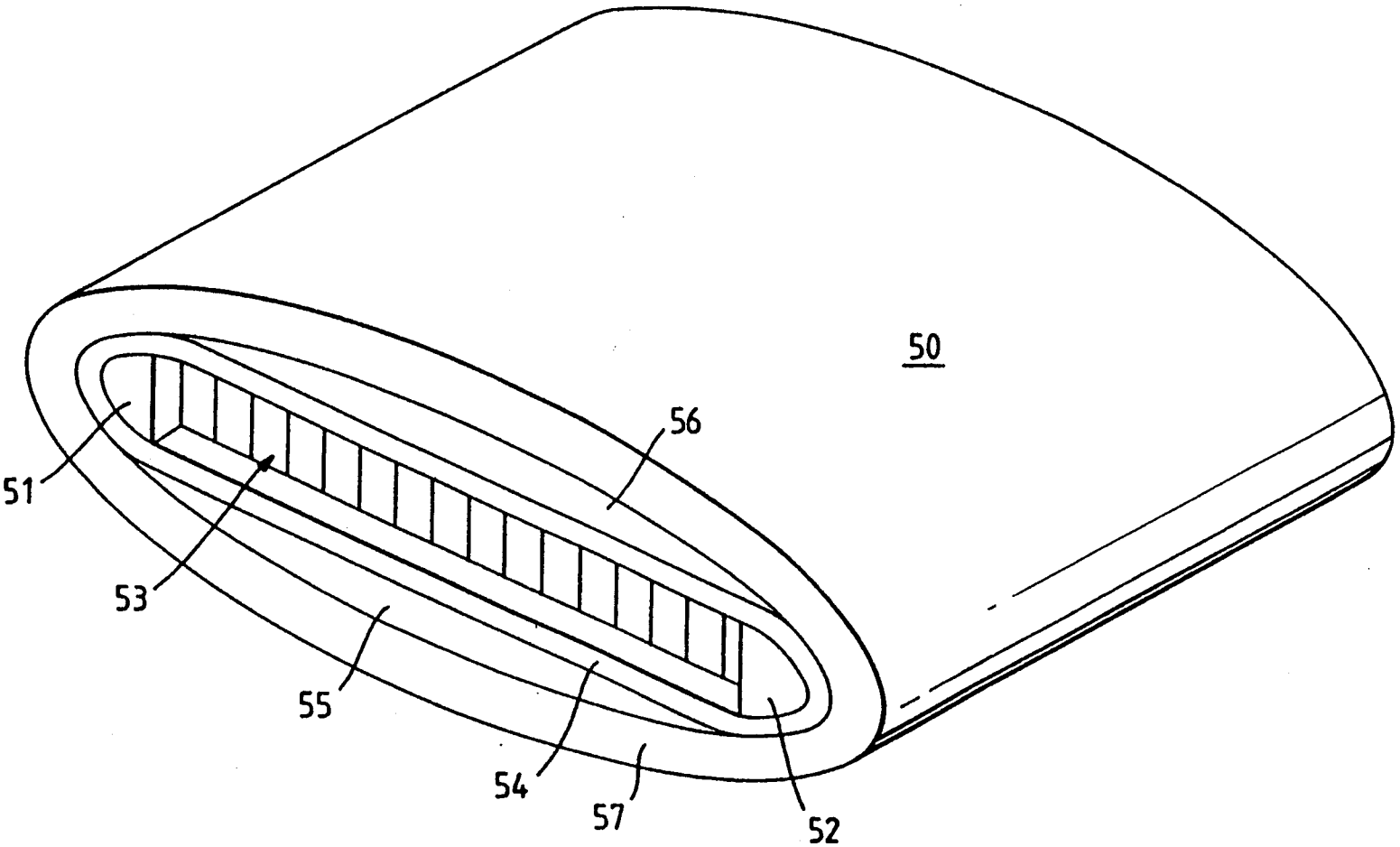
FIG. 5 shows a perspective view of an alternative arrangement of flextensional transducer.

FIG. 5 shows an alternative arrangement of the flextensional transducer 50. Shell inserts 51 and 52 are assembled with a number of spaced transducer stacks 53 of which one is shown. A pre-stress compression band 54 of filament-wound Kevlar (Registered Trade Mark) is applied around the stack assembly. Partially elliptical plaster supports 55, 56 are then attached to the outer surfaces of the Kevlar band such that the complete assembly provides an elliptical former around which the GRP elliptical shell 57 can be wound. The Kevlar compression band 54 and associated plaster supports 55, 56 provide sufficient support to ensure that the elliptical shell 57 is wound with the required tension for correct operation of the transducer. After curing of the shell 57 the plaster supports 55, 56 are removed. The glass-resin system used to make the shell 57 is selected to retain a high residual stress during curing.

Once the stack-shell assembly is completed end plates are attached having a bonded serrated neoprene seal. The complete transducer is then dip coated in liquid neoprene.

The invention described greatly facilitates the manufacture of the transducer compared with the conventional techniques since there is no requirement for the use of a high pressure press to extend the major axis of a pre-manufactured shell in order to insert the piezo-electric stack assemblies. In addition there is no need for carefully machined wedges to adjust the tension force in the shell acting along the lengths of the piezo-electric stacks.

Figure 6:
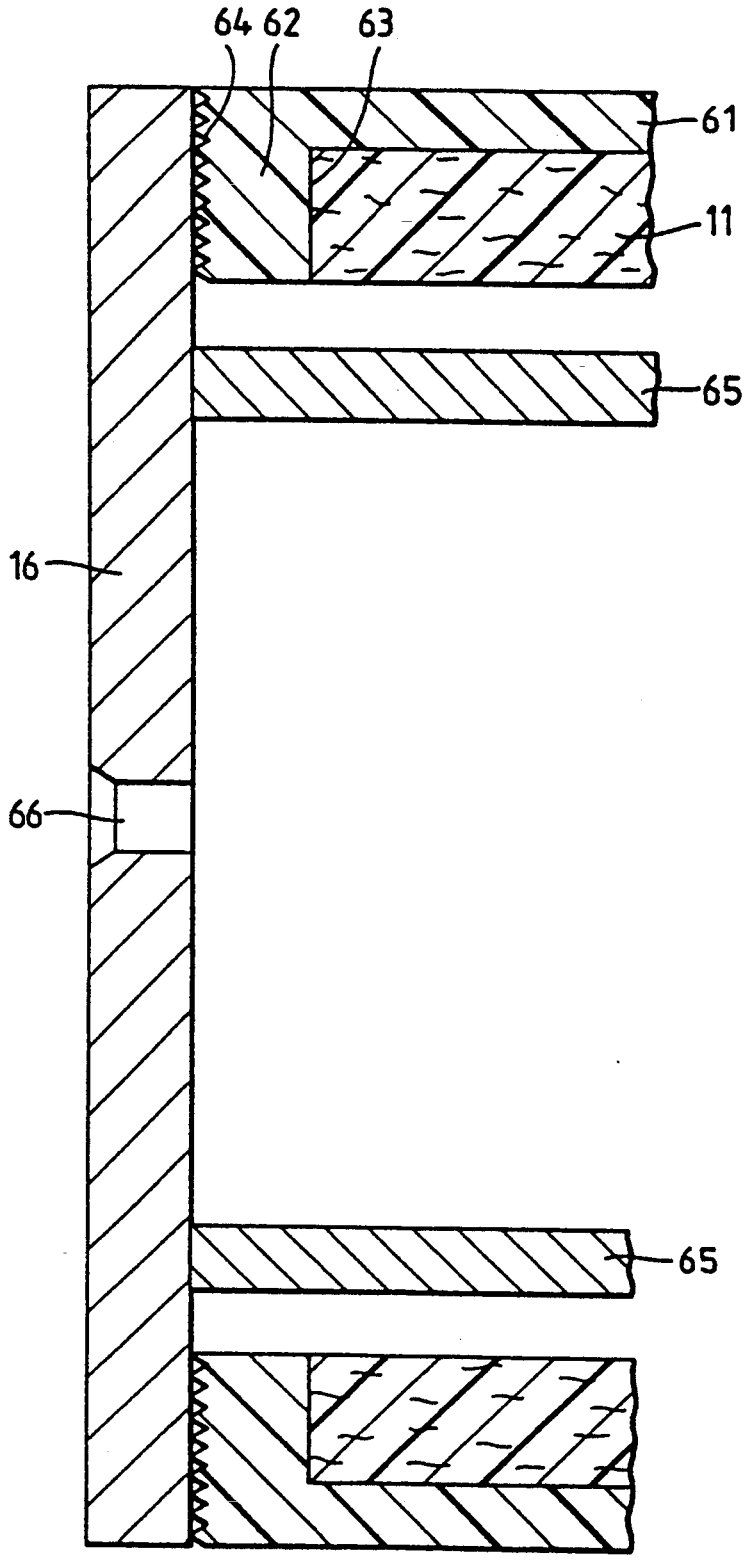
FIG. 6 is a cut-away view of a shell/end plate sealing arrangement.

FIG. 6 shows the sealing arrangement between the elliptical GRP shell 11 and one of the steel end plates 16. The shell 11 has a bonded neoprene coating 61 on its outer surface and integrally formed therewith is an end seal 62 bonded to the end face 63 of the shell 11. The end seal 62 is formed on its outer surface, adjacent to the steel end plate 16, with concentric serrations 64 running around the elliptical seal. A plurality of tie rods 65 are connected between the end faces and, on assembly of the transducer, the lengths of the tie rods are adjusted to determine the required compression of the end seal between the end plates and the shell. The degree of compression is determined by the depth of the serrations in the seal. Compressing the rubber reduces its shear modulus thereby enhancing acoustic decoupling. The overall thickness of the seal is determined by the peak magnitude of the shell vibration and the requirement to limit the sheer stress angle to 30 deg.

The neoprene coating 61 and lip seals 62 are compression bonded to the GRP shell 11 in the following way. After being treated with appropriate bonding preparations, the shell is placed on a support mandrel, enclosed in a steel mould, and the neoprene compression moulded and bonded to the shell in a heated platen hydraulic press. An opening 66 is provided for entry of an electrical cable to the transducer stacks.

The water integrity of the seal has been tested to a hydrostatic pressure of 2 MPa and dynamically tested at full power for 350 hours. In addition access to the inside of the transducer, for example, for replacing piezo-electric stack elements.

In an alternative arrangement the serrated lip seal may be compression bonded to each end plate 16 and the complete assembly then dip coated with a sealing agent, advantageously liquid neoprene.

Figure 7:
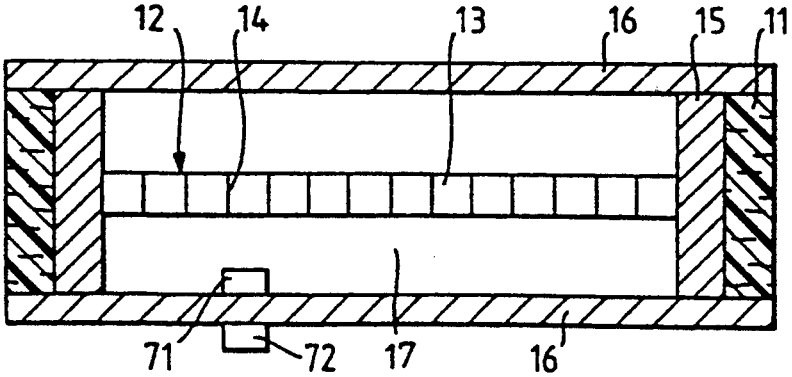
FIG. 7 is a modification of the FIG. 2 arrangement to provide depth compensation.

In the arrangement shown in FIG. 7 attached to one end plate 16 within the cavity 17 is a thermostatically controlled heater 71 controlled by a unit 72 outside the cavity. The unit 72 includes a pressure transducer for measuring the pressure of the ambient medium 70 and a control circuit to provide suitable temperature control signals to the thermostatic heater 71. Details of the unit 72 are not shown since they will be readily apparent to those experienced in this field.

Figure 8:
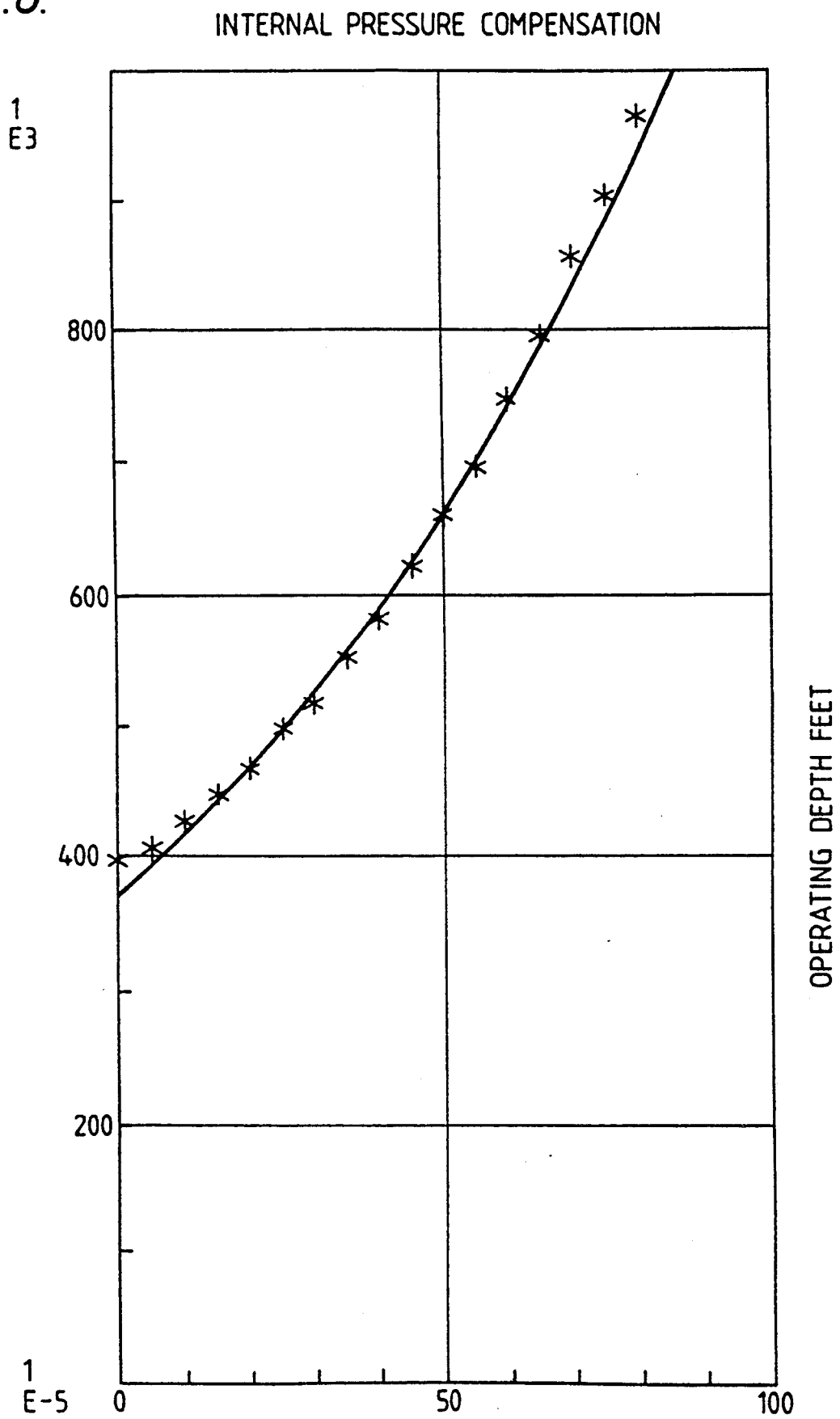
FIG. 8 shows the vapour pressure vs temperature characteristic of dichlorodifluoromethane.

FIG. 8 shows the variation with temperature of the vapour pressure of dichlorodifluoromethane measured in feet of water. The control circuit regulating the setting of the thermostatic heater 71 acting on the dichlorodifluoromethane is arranged to match the pressure within the cavity 17 to the hydrostatic pressure of the surrounding medium 70. By this means the tension in the flexural shell 11 is maintained substantially constant and the piezo-electric elements act under the same operating conditions throughout a wide range of pressure depths. Dichlorodifluoromethane has a relatively low vapour pressure at ambient temperatures and a vapour pressure of 250 PSIA at 65° C.

In addition to providing a relatively simple pressure compensating mechanism, the use of gases similar to dichlorodifluoromethane in place of the conventionally used air or nitrogen helps to control the dissipation of waste heat. Heat generated by the active elements of the transducer during high power operation can lead to thermal runaway under some operating conditions with air or nitrogen filled cavities. Although the thermal conductivity of dichlorodifluoromethane is less than air or nitrogen it has a higher heat capacity and lower gaseous viscosity leading to a higher heat transfer capability and improved heat dissipation capability when used in sonar transducers. This enables the transducer to operate at a higher power duty cycle or higher ambient temperature and hence greater operating depth without thermal runaway.

A further advantage results from the increased insulating effect with increased depth of the dichlorodifluoromethane and similar gases. In many conventional high power transducers the factor limiting the range of use is the breakdown voltage of the cavity medium at the applied electric field. Transducers filled with these gases generating relatively high internal depth compensation pressures could therefore be subjected to a greater electric field and hence generate more power.

As an alternative to filling the cavity 17 directly with gas a bladder filled with the gas may be provided inside the cavity 17. Thermostatic controlled heating of the gas would then be carried out inside the bladder. Alternatively the gas may be used to fill one section of a dual bladder inside the cavity of the transducer 17. The other section of the bladder would then be filled with seawater by providing a conduit connected to external seawater at ambient hydrostatic pressure.

Figure 9:
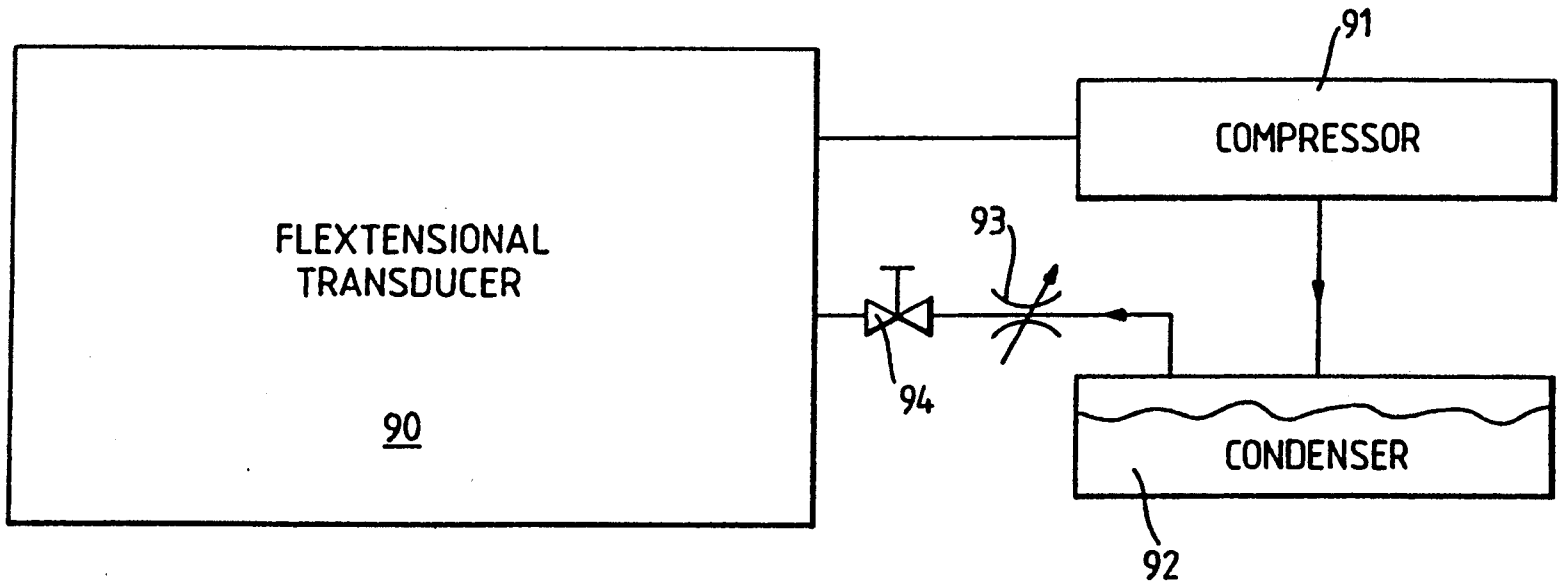
FIG. 9 shows an alternative vapour control mechanism for extending the depth capability of the transducer.

In an alternative arrangement closed or open cycle refrigeration systems may be coupled to the flextensional transducer to control the pressure of a refrigerant gas inside the transducer. A simplified system is illustrated in FIG. 9 wherein the interior of the flextensional transducer shell 90 is included in a refrigeration loop including a compressor 91 and a condenser 92. A control system (not shown) is required to start the compressor 91 when the pressure difference between the seawater and the refrigerant was lower than required, and to actuate the throttle valve 93 allowing vapour to enter the shell 90 from the condenser 92 in the converse situation. The condenser 92 thus acts as a refrigerant reservoir. A stop valve 94 is included in the line between the condenser 92 and the transducer 90. In order to operate with a refrigeration system the initial bias stress of the elliptical shell must be arranged such that the vapour pressure variation achieved by the refrigeration equipment maintains the bias stress on the piezo-electric stacks within design limits.

Figure 10:
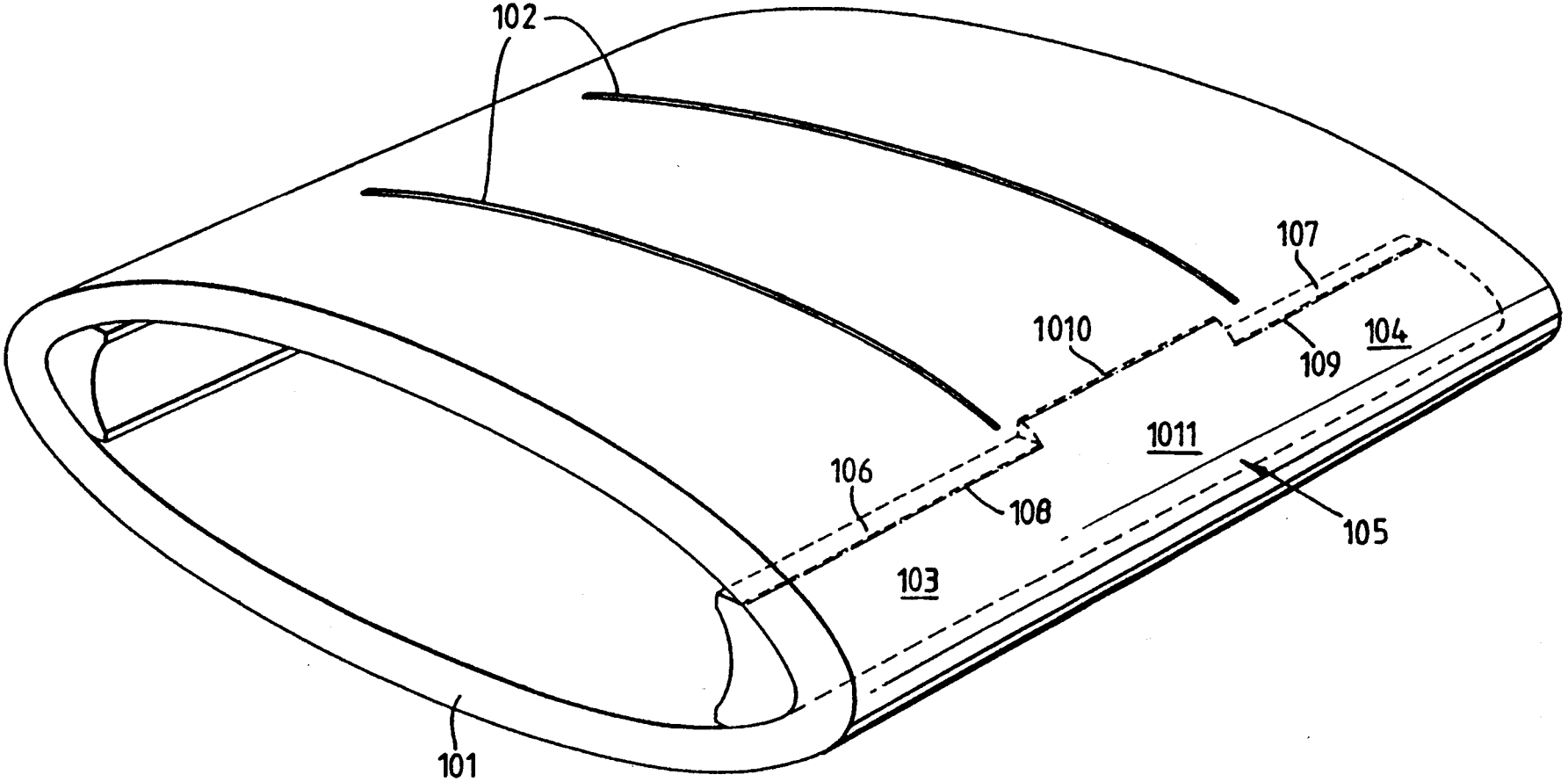
FIG. 10 is a perspective view of a further form of flextensional transducer.

FIG. 10 shows a flextensional transducer modified for broadband operation. The elliptical shell 101 is GRP as before but its outer surface is formed with two grooves 102 transverse to the shell length on the lower surface as well as the upper surface as shown. The outer portions 103 and 104 of the insert 105 have their edges 106,107 cut away with the edges of the cut-away portions corresponding approximately to the positions of the shell grooves 102. The grooves 102 extend substantially as far as each fulcrum 108, 109 and may be formed by sawing substantially through the shell. As shown the cut-away edges 106, 107 result in the fulcra 108, 109 of the end portions 103, 104 of the shell being displaced from the fulcrum 1010 of the centre portion 1011 of the insert. The effective beam length of the centre portion of the shell 1011 is thus less than the effective beam length for the outer portions of the shell. By segmenting the shell in providing the weakening grooves 102 each segment is partly decoupled from the adjacent segments and thus the beam can be made to vibrate at more than one fundamental flexural mode resonance on excitation by driving the piezo-electric stack 1012 at these frequencies.

The number of segments can be larger than three and each segment could have a different effective beam length by appropriate forming of the inserts 105. Typical frequency variations of ±30% from a mean value of flexural resonance have been achieved with the present invention. The radiated power in each component can be predetermined. It has been found that this is related to the dimensions of the radiating surface and to the flexural resonant frequency. Thus the disposition of the segments can be arranged to enable the shape of the acoustic power frequency response to match a required characteristic. For example the segments can be arranged to reduce the peak power and widen the effective band-width.

Figure 11:
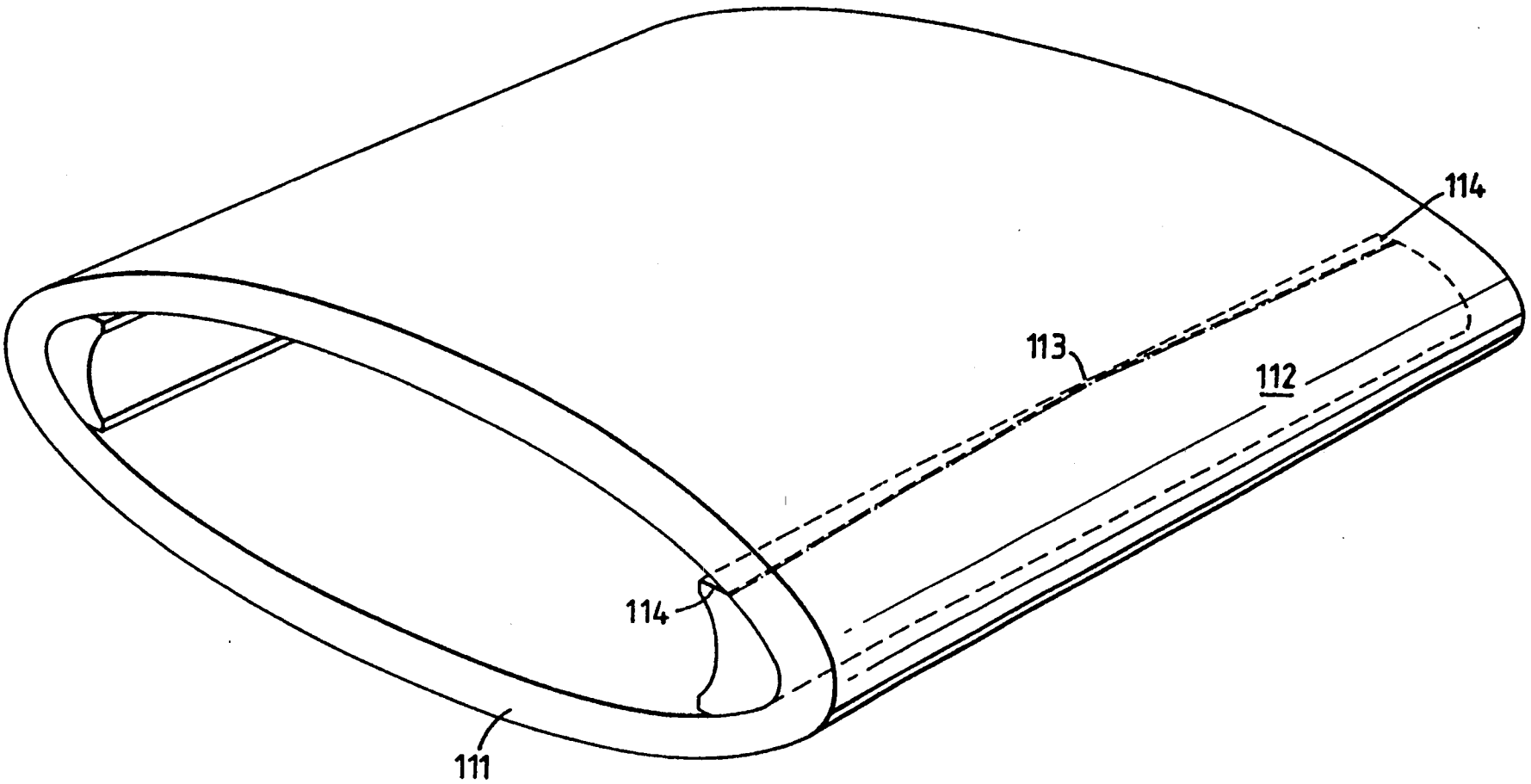
FIG. 11 is a perspective view of an alternative arrangement to FIG. 10.

FIG. 11 shows an alternative embodiment of the invention. In this form the elliptical shell 111 is uniform along its length without segmentation. In place of the step-wise change of profile of the insert as in FIG. 10 there is a gradual change along the length of the insert such that the effective beam length is a maximum at each end of the shell and a minimum at the centre. This is done by a gradual cut-away at the top and bottom edges of the insert 112 from zero at the center 113 to a maximum at the ends 114. With sufficient lateral decoupling in the GRP shell 111 there will be a consequential gradual change in flexural resonance along the length of the shell. Although the FIG. 11 arrangement is shown such that there is symmetry about the centre of the shell, other gradual changes of the effective beam length may be used as for example by gradually increasing the effective beam length throughout the length of the shell.

Modifications of the invention will be apparent to those skilled in the art all falling within the scope of the invention defined herein.

We claim:

1. An elliptical shell flextensional sonar transducer of the kind comprising:

a hollow flexural shell of elliptical cross-section;

a pair of spaced shell inserts;

at least one stack (12) of piezo-electric elements (13) interspaced by electrically conducting plates (14), said at least one stack being in coplanar parallel spaced arrangement between said pair of spaced shell inserts (15), said stacks and inserts being disposed in the plane including a major axis of said hollow flexural shell (11) with outer surfaces of the inserts in contact with the opposed inner surfaces of the shell and so shaped as to support the elliptical shape of the shell; and a pair of resilient rectangular supports (35, 36, 55, 56) in spaced relationship, each support being in retaining contact with the two inserts and with one face making contact over its entire surface area with the adjacent inner surface of the shell.

2. A flextensional transducer as claimed in claim 1 wherein the supports (35,36,55,56) are so formed that when in the unstressed condition they may be assembled with the shell inserts (31,32,51,52) so as to form a support body generally elliptical in cross-section and in conformity with the inner cross-section of the shell.

3. A flextensional transducer as claimed in claim 2 wherein the rectangular supports are sheets (35,36) made of glass reinforced plastic and the shell inserts (31,32) are provided with recesses for locating/retaining the support sheets in position.

4. A flextensional transducer as claimed in claim 2 wherein the rectangular supports comprise a stiff filament-wound layer (54) encircling the piezo-electric stacks together with partially-elliptical formers (55,56).

5. A flextensional transducer as claimed as claimed in claim 4 wherein the stiff filament is Kevlar and the partially elliptical formers are made of plaster so as to be removeable after forming the shell.

6. A flextensional transducer as claimed in claim 1 wherein there is provided a sealing member (62) for sealing between the end plates and the flexural shell, the sealing member (62) being a low shear modulus rubber vulcanised moulded to the outer surface of the flexural shell to form a continuous outer coating with integral lip seals (64) on the end surfaces of the shell.

7. A flextensional transducer as claimed in claim 6 wherein the rubber is neoprene rubber and is provided with a plurality of concentric elliptical serrations (64) on the outer surface of the lip seal for contact with the respective end plate.

8. A flextensional transducer as claimed in claim 7 wherein the degree of compression of the lip seal between the shell and the lip seal is between 10% and 30%.

9. A flextensional transducer as claimed in claim 7 wherein the thickness of the seal is such that the sheer stress angle is limited to 30 deg.

10. A flextensional transducer as claimed in claim 6 wherein a plurality of tie bars is fixed between the two end plates (16) and located inside or outside the shell to determine the compression of the lip seals.

11. A flextensional transducer as claimed in claim 1 wherein there is provided a pressure compensation means comprising:

a cavity defined in part by the shell of the flextensional transducer;

a gas contained in the cavity;

means (71,92) to vary the temperature of the gas;

a depth pressure sensor (72); and a control circuit; the control circuit being connected to the pressure sensor and the temperature varying means to control the temperature of the gas such that the gas vapour pressure acting on the inner side of the shell is substantially the same as the depth pressure.

12. A flextensional transducer as claimed in claim 11 wherein the temperature varying means is a heating element.

13. A flextensional transducer as claimed in claim 11 wherein the gas fills the cavity.

14. A flextensional transducer as claimed in claim 11 wherein the gas fills a bladder within the cavity.

15. A flextensional transducer as claimed in claim 11 wherein the cavity contains a dual bladder, the gas filling one section of the bladder and seawater the other section; the bladder being arranged in such a way that the gas is compressed by the external ambient hydrostatic pressure.

16. A flextensional transducer as claimed in claim 11 wherein the gas is dichlorodifluoromethane.

17. A flextensional transducer as claimed in claim 1 wherein the two inserts located one at each end of the major axis between the shell wall and the corresponding end of the transducer stack and generally "D" shaped in cross section to maintain the elliptical shape of the shell are formed such that the arcuate length of each insert surface in contact with the shell wall (103,104,105) changes along the length of the shell cylinder.

18. A flextensional transducer as claimed in claim 17 wherein there are one or more discrete length changes of the arcuate surface (103,104,105) of each insert.

19. A flextensional transducer as claimed in claim 18 wherein the shell is segmented along its length with weakened regions (102) corresponding to the positions of changing cross section of the inserts.

20. A flextensional transducer as claimed in claim 17 wherein the shell is uniform along its length the arcuate profile of each insert cross section is progressively changed along the length or part of the length of the shell (113,114).

21. A method of making an elliptical shell flextensional transducer comprising the successive steps of:

a) assembling at least one piezo-electric stack (38,53) between opposed shell inserts (31,32,51,52) and spaced lengthwise of the inserts, and two spaced rectangular supports (35,36,55,56) between the inserts such that the inserts and the supports form a uniform cylindrical support body with an elliptical outer cross-section; and b) winding a resin-soaked filament around the assembly to form the elliptical shell (37,57).

22. A method as claimed in claim 21 wherein the supports are sheets (35,36) and the supports and shell (37) are made from glass reinforced plastic.

23. A method as claimed in claim 21 wherein the tension in the filament wound around the support body assembly is controlled such that the completed elliptical shell exerts a predetermined stress force along the lengths of the piezo-electric stacks.

24. A method as claimed in claim 21 wherein there is included the further step of winding a layer of a stiff filamentary material (54) around the assembly of the or each piezo-electric stack (53) and opposed shell inserts (51,52) and attaching or forming partially elliptical supports (55,56) on the outside surfaces of the layer between the inserts, the support material being selected such that it can be removed after winding the flexural elliptical shell.

25. A method as claimed in claim 24 wherein the layer filament is Kevlar and the supports are made of plaster.

26. A method of making a flextensional transducer as claimed in claim 6 including the further step of sealing end plates to the flextensional transducer comprising:

a) locating the shell (11) on a supporting mandrel;

b) compression moulding a low shear modulus rubber coating (61), for example neoprene, over the outer surface of the shell to form a lip seal (62) integral therewith on each end of the shell;

c) assembling end-plates (16) to the shell and tightening tie-bars between the end plates so as to give the required compression of the end plate seals between each end plate and its respective shell end.

27. A method as claimed in claim 26 wherein the compression moulding is done in a hydraulic press.

28. A method as claimed in claim 26 wherein during assembly of the transducer a plurality of tie-bars interconnecting the end plates are adjusted in length to achieve the desired compression of the lip seals.

29. A method as claimed in claim 26 wherein as a final step the complete transducer is dip-coated in liquid neoprene.

* * * * *